US006287222B1

(12) United States Patent
Pitsenberger

(10) Patent No.: US 6,287,222 B1
(45) **Date of Patent: *Sep. 11, 2001**

(54) METAL BAT WITH EXTERIOR SHELL

(75) Inventor: Dan S. Pitsenberger, Tullahoma, TN (US)

(73) Assignee: Worth, Inc., Tullahoma, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/570,641

(22) Filed: May 15, 2000

Related U.S. Application Data

(60) Continuation of application No. 09/515,735, filed on Feb. 29, 2000, now Pat. No. 6,159,116, which is a division of application No. 08/959,418, filed on Oct. 28, 1997, now Pat. No. 6,053,828.

(51) Int. Cl.[7] ..... A63B 59/06
(52) U.S. Cl. ..... 473/566
(58) Field of Search ..... 473/566, 567, 473/564, 565, 568, FOR 169, FOR 170

(56) References Cited

U.S. PATENT DOCUMENTS

| | | | |
|---|---|---|---|
| Re. 31,811 | 1/1985 | Foreman | 273/72 |
| 875,273 | 12/1907 | Kimble . | |
| 1,499,128 | 6/1924 | Shroyer, Jr. . | |
| 3,116,926 | 1/1964 | Owen et al. | 273/72 |
| 3,359,142 | 12/1967 | Ward, Jr. | 29/197 |
| 3,479,030 | 11/1969 | Merola | 273/72 |
| 3,508,748 | 4/1970 | Strimel | 273/26 |

(List continued on next page.)

FOREIGN PATENT DOCUMENTS

| | | | | |
|---|---|---|---|---|
| 406091026 | * | 4/1994 | (JP) | 473/566 |
| 5-57042 | * | 4/1994 | (JP) | 473/566 |

OTHER PUBLICATIONS

Japanese Pat. No. 8–257187 –Oct. 8, 1996.

Japanese Pat. No. 10–314353 –Dec. 2, 1998.

Japanese Pat. No. 7–163693 –Jun. 27, 1995.

*Primary Examiner*—Mark S. Graham
(74) *Attorney, Agent, or Firm*—Waddey & Patterson; Lucian Wayne Beavers

(57) ABSTRACT

A bat comprising a tubular body having a handle portion, a tapered mid-section and a barrel or impact portion. The barrel portion merges with the tapered mid-section at an annular indentation formed in the body. The bat further includes an exterior shell disposed about the barrel portion of the bat in a manner that enables unrestricted movement of the shell upon impact with a ball. The opposing ends of the shell are cooperatively tapered with opposing ends of the barrel portion. The bat further includes a knob attached at the terminus of the handle portion, and an end cap attached at a terminus of the sleeve and barrel portion.

10 Claims, 1 Drawing Sheet

U.S. PATENT DOCUMENTS

| | | | |
|---|---|---|---|
| 3,802,850 | 4/1974 | Clougherty | 29/182 |
| 3,861,682 | 1/1975 | Fujii | 273/72 |
| 3,955,816 | 5/1976 | Bratt | 273/26 |
| 3,963,239 | 6/1976 | Fujii | 273/72 |
| 4,113,248 | 9/1978 | Yanagioka | 273/72 |
| 4,241,919 | 12/1980 | Foreman | 273/72 |
| 4,260,150 | 4/1981 | Tabet | 273/26 |
| 4,274,631 | 6/1981 | Hayazaki | 273/26 |
| 4,505,479 | 3/1985 | Souders | 273/72 |
| 4,546,976 | 10/1985 | Jones | 273/72 |
| 4,551,219 | 11/1985 | Flick et al. | 204/290 |
| 4,682,773 | 7/1987 | Pomilia | 273/26 |
| 4,731,115 | 3/1988 | Abkowitz et al. | 75/236 |
| 4,744,136 | 5/1988 | Foreman et al. | 29/451 |
| 4,746,117 | 5/1988 | Noble et al. | 273/72 |
| 4,763,899 | 8/1988 | Hundley | 273/26 |
| 4,819,935 | 4/1989 | Dirksing et al. | 272/124 |
| 4,834,370 | 5/1989 | Noble et al. | 273/72 |
| 4,898,386 | 2/1990 | Anderson . | |
| 4,906,430 | 3/1990 | Abkowitz et al. | 419/6 |
| 4,907,800 | 3/1990 | Passamaneck et al. | 273/26 |
| 4,961,576 | 10/1990 | Meridith | 273/80 |
| 4,968,348 | 11/1990 | Abkowitz et al. | 75/244 |
| 5,050,877 | 9/1991 | Wales | 273/26 |
| 5,170,664 | 12/1992 | Hirsh et al. | 73/493 |
| 5,277,421 | 1/1994 | Rewolinski | 273/26 |
| 5,360,209 | 11/1994 | Moliica . | |
| 5,364,095 | 11/1994 | Easton et al. | 273/72 |
| 5,393,855 | 2/1995 | McKay | 273/72 |
| 5,395,107 | 3/1995 | De Pippo | 273/26 |
| 5,415,398 | 5/1995 | Eggiman | 273/72 |
| 5,511,777 | 4/1996 | McNeely | 273/72 |
| 5,578,384 | 11/1996 | Kingston | 428/608 |
| 5,620,652 | 4/1997 | Tack et al. | 420/532 |
| 5,676,609 * | 10/1997 | Mollebaek | 473/564 |
| 5,722,908 * | 3/1998 | Feeney et al. | 473/567 |
| 5,980,602 | 11/1999 | Carden | 420/532 |
| 6,053,828 * | 4/2000 | Pitsenberger | 473/566 |
| 6,056,655 | 5/2000 | Feeney et al. | 75/236 |
| 6,143,429 | 11/2000 | Abkowitz et al. | 473/567 |

* cited by examiner

METAL BAT WITH EXTERIOR SHELL

This application is a continuation of my prior U.S. patent application Ser. No. 09/515,735 filed Feb. 29, 2000, now U.S. Pat. No. 6,159,116, which is a divisional of my prior U.S. patent application Ser. No. 08/959,418 entitled "Softball bat With Exterior Shell", filed Oct. 28, 1997, now U.S. Pat. No. 6,053,828 issued Apr. 25, 2000.

BACKGROUND OF THE INVENTION

The present invention relates generally to softball and baseball bats, and more particularly to such bats having an exterior shell covering at least a portion of the bat.

In an effort to continually improve bats, manufacturers seek out new materials and designs. Most top of the line bats utilize the highest tensile and yield-strength alloys available, such as the 7000 series hard alloys, titanium and composites, all of which are readily available to manufacturers. Thus, in an effort to differentiate products constructed of the same materials, manufacturers and engineers focus on the development of features that will enhance the performance and durability of the bat. To this end, there have been several attempts to design bats which include structural features to maximize performance and/or reinforce the interior of the tube for increased durability.

One such attempt was disclosed in U.S. Pat. No. 5,364,095, assigned to Easton, Inc., which is incorporated by reference as if fully set forth herein, is directed to a tubular metal ball bat internally reinforced with fiber composite. The bat comprises a hollow metal tube including a metal sleeve compressively engaged with the interior of the tube. The sleeve is formed of carbon fibers in an epoxy matrix.

U.S. Pat. No. 5,511,777, issued to McNeely, which is incorporated by reference as if fully set forth herein, is directed to a ball bat with rebound core. The McNeely invention comprises a hollow tube having a tube wall including a barrel portion, a tapered portion and a handle portion. The bat includes an inner damper that is covered by a resilient attenuator sleeve. The inner damper is inserted into the hollow tube such that the resilient attenuator sleeve is compressed between the inner damper and the tube wall. A cap covers the open top of the tube and a knob is installed to the open bottom.

U.S. Pat. No. 5,415,398, issued to Eggiman, which is incorporated by reference as if fully set forth herein, is directed to a softball bat having a tubular insert. A tubular aluminum bat frame is provided with a large diameter impact portion, an intermediate tapering portion, and a small-diameter handle portion. A tubular insert is suspended within the impact portion by interference fits at each insert end. A gap exists along the length of the suspended insert separating the insert from the interior of the impact portion. The gap is filled with grease to facilitate relative movement between the insert and the tubular frame when a ball is batted.

All of the aforementioned devices utilize an interior reinforcing mechanism with an exterior tube of uniform wall thickness. What is needed then, is a bat having an exterior shell covering and in direct communication with a portion of the bat body.

SUMMARY OF THE INVENTION

The bat of the present invention comprises a tubular body having a handle portion, a tapered mid-section and a barrel or impact portion. The bat further includes an exterior shell disposed about the barrel portion of the bat in a manner that enables unrestricted movement of the shell upon impact with a ball. The opposing ends of the shell are cooperatively tapered with opposing ends of the barrel portion.

An interior surface of the shell is preferably in direct flush engagement with an exterior surface of the barrel portion; however, it is also comtemplated that the surfaces may contact one another at random locations.

An annular indentation or dimple is formed in the body at the point at which the barrel portion merges with the tapered mid-section. The handle portion of the bat terminates at a knob attached, and the open ends of the barrel portion and the shell are covered by an end cap.

The bat may be constructed from any suitable material, such as aluminum, titanium, composites and the like.

It is an object of the present invention to provide a bat having a handle portion, a mid-section and a barrel portion with an exterior shell.

It is another object of the present invention to provide a bat having an exterior shell with opposing ends that are cooperatively tapered with opposing ends of the barrel portion.

It is another object of the present invention to provide a bat wherein the barrel portion and the mid-section merge at an annular indentation.

It is yet another object of the present invention to provide a bat having a shell with an interior surface that directly engages an exterior surface of the barrel portion.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
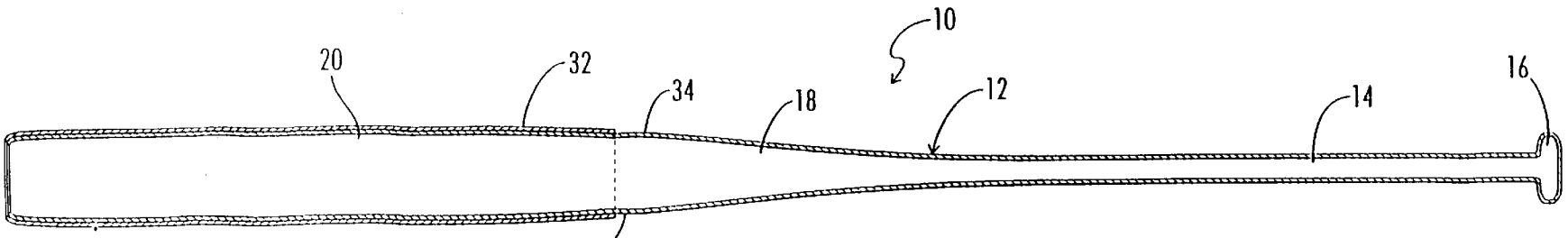
FIG. 1 is a cross-sectional view of a bat having an exterior shell in accordance with the present invention.

An embodiment of the present invention is designated generally by the reference numeral 10 in FIG. 1. Bat 10 comprises an elongated, tubular body 12 having a handle portion 14, a tapered mid-section 18, and a barrel or impact portion 20. The handle portion 14 terminates in a knob 16. The diameter of the mid-section 18 increases as it approaches a point of intersection with the barrel portion 20.

The body 12 includes an annular indentation or dimple 24 at the intersection of the mid-section 18 and the barrel portion 20. Accordingly, the diameter of the tapered mid-section 18 of the body 12 increases to a maximum diameter and then abruptly decreases as the mid-section 18 merges with the barrel portion 20 at the annular indentation 24.

The barrel portion 20 includes spaced-apart, tapered ends 21 and 22. End 21 tapers inwardly and merges with the mid-section 18 at the annular indentation 24. End 22 tapers inwardly toward a tip 25 of the bat 10. Accordingly, the diameter at each end 21 and 22 of the barrel portion 20 is smaller than the diameter of the barrel portion 20 intermediate the ends 21 and 22.

Figure 2:
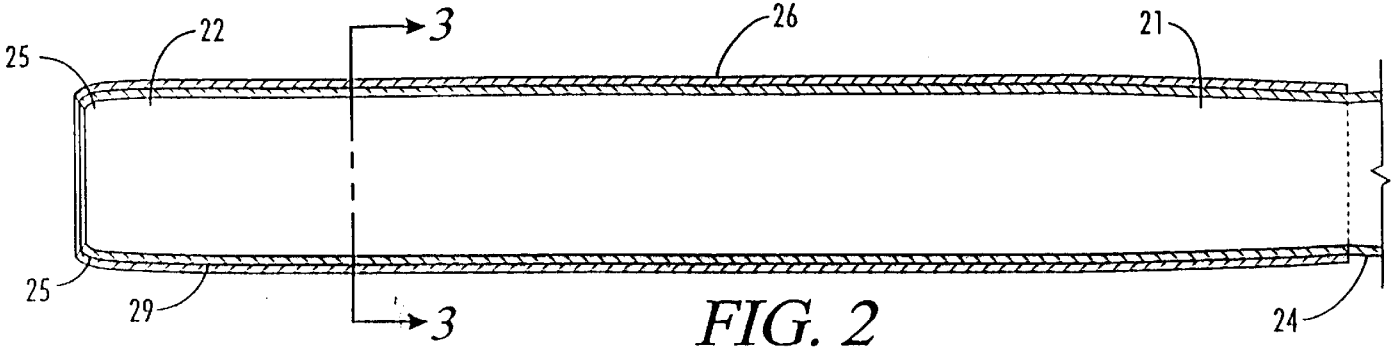
FIG. 2 is an enlarged partial cross-sectional view of the bat shown in FIG. 1.
Figure 3:
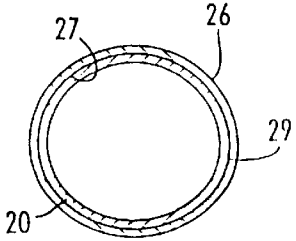
FIG. 3 is a cross-sectional view taken along line 3—3 of FIG. 2 showing the position of the shell relative to the barrel portion of the bat.
Figure 4:
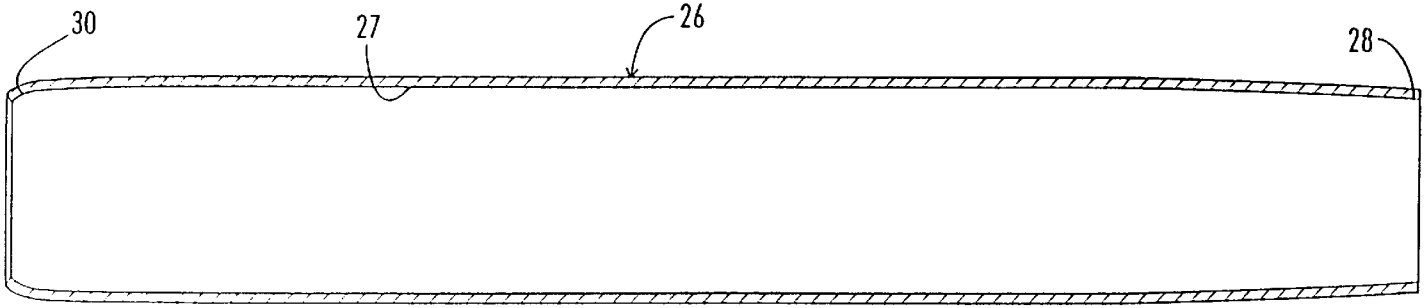
FIG. 4 is a cross-sectional view of the shell of the present invention.

With reference to FIGS. 2 and 3, a shell or sleeve 26 having tapered open ends 28 and 30 is disposed about the barrel portion 20 of the bat 10. In the preferred embodiment, the shell 26 and the barrel portion 20 are cooperatively engaged such that the entire interior surface 27 of the shell 26 is in direct flush engagement with the exterior surface 29 of the barrel portion 20. However, due to process variations in the starting tubes from which the bat 10 is formed, the interior surface 27 of the shell 26 and the exterior surface 29 of the barrel portion 20 may contact one another at the tapered ends and at random locations throughout the barrel portion.

As shown in FIG. 2, the shell 26 terminates at the annular indentation 24. The barrel portion 20 is configured to allow for the added wall thickness of the shell 26 and to enable an exterior surface 32 of the shell 26 to align with an exterior surface 34 of the tapered mid-section 18 to form a substantially smooth and continuous exterior bat surface. Thus, there in no abrupt increase in the diameter of the bat 20 where the shell 26 terminates at the indentation 24.

An end-cap is provided to cover the opening at the ends 22 and 30 of the barrel portion 20 and the shell 26, respectively.

The shell 26 is superposed about the barrel portion 20 of the tubular bat body 12 through a swaging process to eliminate any gap that might otherwise exist between the interior surface 27 of the shell 26 and the exterior surface 29 of the barrel portion 20. The shell 26 is retained in position about the barrel portion 20 by virtue of the tapered ends 28 and 30, and not affixed to the barrel portion 20 by any mechanical means, such as adhesives or fasteners. Thus, the shell 26 is capable of unrestricted longitudinal movement with respect to the barrel portion 20, and deflects longitudinally upon impact with a ball.

The bat 10 of the present invention may be produced using a variety of manufacturing methods. For example, the shell 26 may be disposed about a starting tube using a lubricant, which is subsequently removed during heat treatment of the bat. The starting tube, which forms the body 12 of the bat 10, and the shell 26 are tapered simultaneously during a swaging process to create the desired bat shape. The knob 16 and the end cap 32 are then installed on the bat 10.

Thus, although there have been described particular embodiments of the present invention of a new and useful bat with an exterior shell, it is not intended that such references be construed as limitations upon the scope of this invention except as set forth in the following claims.

What I claim is:

1. A bat, comprising:

an aluminum body having a handle portion, a tapered mid-section and a barrel portion, wherein the barrel portion merges with the mid-section at an annular indentation; and an aluminum sleeve surrounding the barrel portion, wherein the sleeve is in direct engagement with but not bonded to the barrel portion.

2. The bat of claim 1, wherein opposing ends of the sleeve are cooperatively tapered with opposing ends of the barrel portion such that an outer diameter at each end is smaller than an outer diameter intermediate the ends.

3. A bat, comprising:

a metal bat body having a handle portion, a tapered mid-section and a barrel portion;

wherein a distal end of the mid-section, which distal end joins the barrel portion, has a reduced diameter annular step defined thereon;

a metal sleeve surrounding the barrel portion and terminating adjacent the reduced diameter step of the mid-section;

wherein the sleeve is in direct engagement with but not bonded to the barrel portion; and wherein the bat body and the sleeve are both constructed of the same metal.

4. The bat of claim 3, wherein the sleeve abuts the step.

5. The bat of claim 3, wherein:

the tapered mid-section increases to a maximum diameter and then abruptly decreases in diameter as the mid-section merges with the barrel portion at the annular step.

6. The bat of claim 3, wherein:

the sleeve has an exterior surface which is aligned with an exterior surface of the tapered mid-section to form a substantially smooth and continuous exterior bat surface across the annular step.

7. A bat, comprising:

an aluminum bat body having a handle portion, a tapered mid-section and a barrel portion;

wherein a distal end of the mid-section, which distal end joins the barrel portion, has a reduced diameter annular step defined thereon, the tapered mid-section increasing to a maximum diameter and then abruptly decreasing in diameter as the mid-section merges with the barrel portion at the annular step; and an aluminum sleeve surrounding the barrel portion and terminating adjacent the reduced diameter step of the mid-section, the sleeve having an exterior surface which is aligned with an exterior surface of the tapered mid-section to form a substantially smooth and continuous exterior bat surface across the annular step.

8. The bat of claim 7, wherein interior surfaces of the ends of the sleeve are in flush engagement with an exterior surface of the barrel portion.

9. The bat of claim 3, wherein the bat body and the sleeve are both constructed of aluminum.

10. The bat of claim 3, wherein interior surfaces of the ends of the sleeve are in flush engagement with an exterior surface of the barrel portion.

* * * * *